US006667431B1

(12) United States Patent
Norman

(10) Patent No.: US 6,667,431 B1
(45) Date of Patent: Dec. 23, 2003

(54) STRINGED INSTRUMENT

(76) Inventor: William E. Norman, 6645 Dunham Rd., Walton Hills, OH (US) 44146

( * ) Notice: Subject to any disclaimer, the term of this patent is extended or adjusted under 35 U.S.C. 154(b) by 0 days.

(21) Appl. No.: 10/254,300

(22) Filed: Sep. 25, 2002

(51) Int. Cl.[7] ..... G10C 3/18
(52) U.S. Cl. ..... 84/290; 84/291
(58) Field of Search ..... 84/290, 291, 267

(56) References Cited

U.S. PATENT DOCUMENTS 5,994,633 A * 11/1999 Norton ..... 84/290
6,051,773 A * 4/2000 Rose ..... 84/743

* cited by examiner

*Primary Examiner*—Kimberly Lockett
(74) *Attorney, Agent, or Firm*—Watts Hoffmann Co.

(57) ABSTRACT

The present invention is directed to a stringed instrument including a body portion, a rigid frame portion and a neck, wherein the neck is attached to the body portion at one end. The rigid frame portion comprises a top and bottom extension cut away from and running generally parallel and coplanar to the length of the neck. The top and bottom extensions pass beyond the neck and join together beyond the distal end of the neck without contacting the neck. The instrument also comprises a plurality of strings attached to the body portion of the instrument extending from the body portion lengthwise of the neck to a plurality of tuning machines located on an extended headstock section of the frame portion such that the neck is not stressed by the tension of the strings.

15 Claims, 2 Drawing Sheets

STRINGED INSTRUMENT

FIELD OF THE INVENTION

The present invention relates to stringed musical instruments, more particularly to instruments having a long fretted neck and steel strings such as a guitar and the like.

BACKGROUND

Stringed instruments typically have steel strings that are attached at the upper end of the instrument to tuning machines or gears on the upper end of the neck. The strings run from the upper end of the neck, over a nut and a bridge to the bottom part of the body of the instrument, where they are securely attached. The strings are pulled straight by tension.

Due to the fact that the strings are under considerable tension, there is a strong upward bowing force exerted on the neck of the instrument. To prevent the neck from bowing under the tension, necks are currently constructed to resist the bending propensity. This is accomplished by making the neck with considerable thickness, increasing the thickness towards the point where the neck joins the body. In addition, the neck is constructed out of materials the can withstand the tension placed on the neck by the strings. The thicker neck makes it difficult for persons with small hands or short fingers to reach around the neck to finger the strings. Despite the thicker neck or stronger materials, there is still a tendency for the neck to bow due to the fact that the string tension is constant and over time and the materials will give way to the tension.

When the neck on a conventional instrument bows, the strings are taken further away from the fretted neck thus making the instrument even harder to play. Therefore, there is a need for making a stringed instrument where the neck is free from such tension to prevent it from warping or bending throughout the life of the instrument.

Stringed musical instruments produce sustain generated by the instrument itself. Sustain is defined as the length of time it takes for the plucked string to stop producing tones. The most important factor in producing sustain is the construction of the guitar. The best sustain potential requires that the body and neck be made of one piece of heavy and dense material. There is a need in the art for a musical instrument that can produce quality sustain potential.

SUMMARY OF THE INVENTION

The present invention relates to a stringed musical instrument including but not limited to 4, 6, 7, 8, and 12 string electric, acoustic or semi-acoustic guitars having a solid or hollow body and to 4, 5, and 6 string bass electric, acoustic or semi-acoustic guitars having a solid or hollow body.

The stringed instrument comprises a body portion and a rigid frame portion. A fretted neck is attached to the body portion at one end and a nut is disposed on the neck at the distal end from the body portion. In a preferred embodiment, the rigid frame portion comprises a top and bottom extension cut away from and running generally parallel and coplanar to the length of the neck. The top and bottom extensions pass beyond the neck and join together beyond the distal end of the neck without contacting the neck. The instrument also comprises a plurality of strings attached to the body portion of the instrument. The strings extend from the body portion lengthwise of the fretted neck to a plurality of tuning machines located on the frame portion where the frame portion acts as an extended headstock. The tuning machines allow the user to adjust the tension of the strings for tuning purposes and are attached to the frame portion of the instrument beyond the neck so that the neck is not stressed from the tension of the strings.

In one embodiment of the invention, string tie-downs are affixed to the frame portion of the instrument to hold the strings in place. The string tie-downs are spaced an equal distance from each tuning machine for each corresponding string. In another embodiment of the present invention, the neck is elevated from the frame portion such that a string extending lengthwise from the body portion over the nut produces a downward angle from the nut to the tuning machines. It was found that this downward angle keeps the intonation or action correct at the nut. This prevents "buzzing" and "rattling" while the instrument is being played. It was also found that this downward angle allows the instrument to keep its perfect toning up to concert pitch by keeping all of the notes from being either flat or sharp.

In yet another embodiment of the present invention, the tuning machines are positioned on the frame portion in a manner where the strings extend in a straight line from the body portion over and in contact with the nut to the tuning machines. Preferably, the frame is situated at an angle to the strings to allow each tuning machine to align with its corresponding string so that the strings extend in a straight line from the bridge on the body to the tuning machines. In addition, at least one pick-up is affixed to the body portion under the strings to transmit the vibrational tones created by the strings to the amplifier.

The inventor, unexpectedly, found that the instrument according to the present invention, produces better quality musical tones due the guitar's resonance and structural characteristics. In addition, the design allows for a more even and clear sound quality to be produced by the strings.

DETAILED DESCRIPTION OF THE PREFERRED EMBODIMENTS

Figure 1:
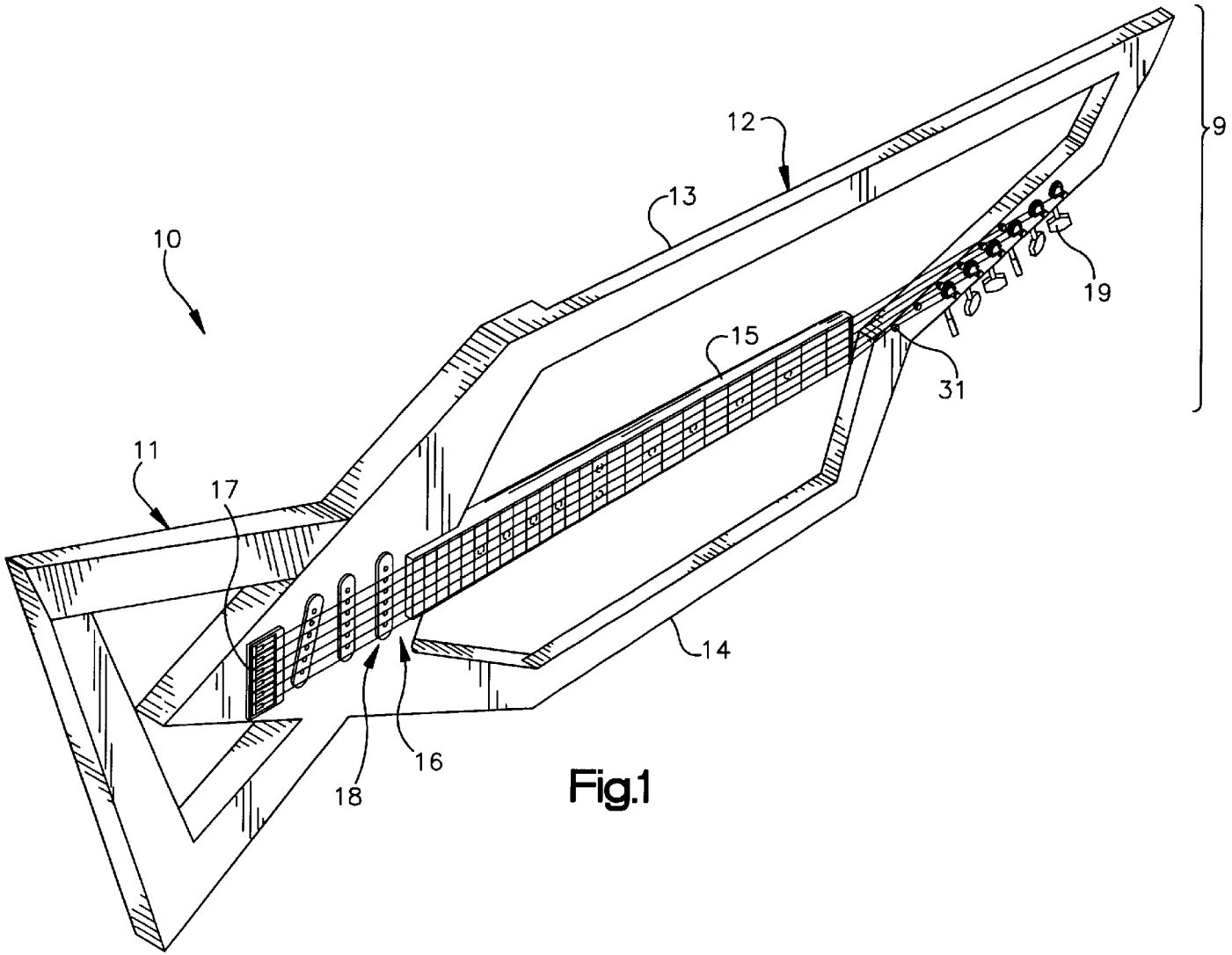
FIG. 1 depicts a perspective view of the stringed instrument of the present invention.

Referring to FIG. 1, the stringed instrument 10 of the present invention is shown. The stringed instrument 10 comprises a body portion indicated generally as 11 said body portion 11 can be of hollow or solid construction, a rigid frame portion indicated generally as 12 and a fretted neck 15. The rigid frame portion 12 comprises a top extension 13, a bottom extension 14 and a joining portion 9. The top extension 13 and bottom extension 14 are cut away from and run generally parallel and coplanar the length of the neck 15. Once the top extension 13 and the bottom extension 14 extend beyond the neck 15 they are connected together by the joining portion 9 such that no part of the rigid frame 12 contacts or is attached to the neck 15. The joining portion 9 can be of any shape or configuration so long as the frame 12 does not contact the neck 15. The body portion 11, rigid frame portion 12 and neck 15 may be constructed from wood, metal, plastic, composite or any other material used to construct guitars as known to those skill in the art.

The fretted neck 15 is attached to the body portion 11 at one end and extends away from the body portion 11, running generally parallel to the top extension 13 and bottom extension 14 to a point just short of the joining portion 9 but not contacting any part of the rigid frame 12. The fretted neck 15 can be attached to the body portion 11 by any means know in the art. Preferably, the fretted neck 15 is glued to the body portion 11. A plurality of strings 16 are fastened to the body 11 via a bridge 17 and extend over one or more pick-ups 18, along and beyond the neck 15 to the joining portion 9. The strings 16 are, preferably, attached to the joining portion 9 by a plurality of tuning machines 19 to allow for adjusting the tension of the strings for tuning purposes. Any suitable tuning machines may be used to practice the invention and such are commercially available.

The body portion 11 can include many additional features common to guitars, especially electric guitars but not shown in the drawings. Such additional features include, but are not limited to, a pick-up guard, pick-up selector, volume and tone controls, an output jack and a tremolo arm.

Figure 2:
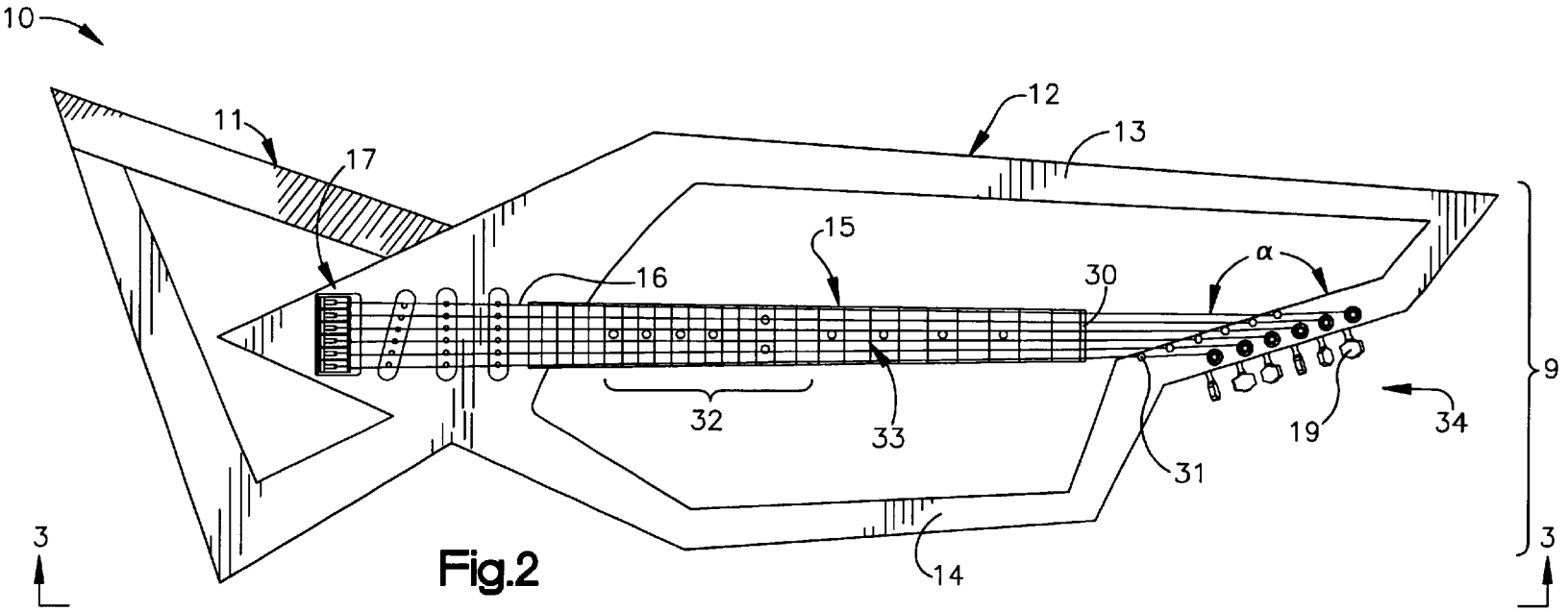
FIG. 2 depicts a top view of the stringed instrument of the present invention.

Referring now to FIG. 2, a front view of the stringed instrument 10 is shown. The neck 15 is attached to the body portion 11 and a nut 30 is affixed to the distal end of the neck 15 from the body portion 11. The strings 16 extend from the bridge 17 along the neck 15, over the nut 30 to the tuning machines 19. The string tie-downs 31 are attached to the frame to secure the strings. The strings pass over the nut 30 and produce a slight downward angle, best shown in FIG. 3, to the string tie-downs 31 before being secured by the tuning machines 19. This slight downward angle allows for continuous tension to be placed on the strings so that the strings maintain their tuning. In addition, joining portion 9 is constructed in a manner such that the strings 16 maintain a straight line from the bridge along the neck to the tuning machines 19.

The joining portion 9 includes a extended head stock portion 34 including tuning machines 19 where the extended headstock portion 34 lies at an angle $\alpha$ to the strings. The angle $\alpha$ is such that the strings 16 maintain a straight line from the bridge 17 to the tuning machines 19. This angle any angle where the strings maintain a straight line from the tuning machines to the bridge, preferably the angle $\alpha$ is 163°. In addition, the string tie-downs 31 are positioned on the extended headstock portion 34 such that the distance between each string tie-down 31 and the tuning machines 19 is the same for each string.

The neck 15 includes a fingerboard 32 wherein the fingerboard 32 contains a plurality of frets 33. In a preferred embodiment of the invention, the portion of the neck 15 opposite of the body portion 11 does not contact the joining portion 9 of the frame 12 at any point. Tension on stringed instruments can be incredible. Most necks on guitars bow over time due to the string tension. The inventor of the present invention has found that by building a rigid frame around the neck 15 and taking up the tension in the frame 12, the neck 15 can be relieved of such tension, allowing for prolonged life of the neck 15 and easier playability of the instrument over time.

Figure 3:
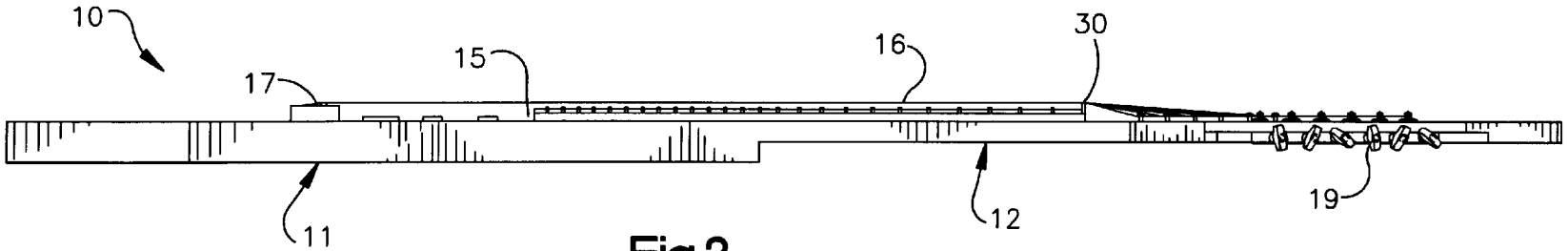
FIG. 3 is an side plan view of the stringed instrument of the present invention taken along lines 3—3 of FIG. 2.

Referring now to FIG. 3, a side view of the stringed instrument 10 is shown. In a preferred embodiment of the invention, the neck 15 is elevated from the body portion 11 and frame portion 12 such that the strings 16 extend from the bridge 17 over the neck and the nut 30 to the tuning machines 19 such that the strings form a downward angle from the nut 30 to the tuning machines 19.

It was unexpectedly found by the inventor that the stringed instrument according to the present invention produces a better sustain than prior instruments. It is believed that by making the body and extensions one unit, vibrational energy is more easily transferred back to the string resulting in a longer and richer sustain. It is also believed that feedback generated by the energy of the vibrating string through the guitar reinforces the original note, allowing the note to decay more slowly.

Many modifications and variations of the invention will be apparent to those of ordinary skill in the art in light of the foregoing disclosure. Therefore, it is to be understood that, within the scope of the appended claims, the invention can be practiced otherwise than has been specifically shown and described.

I claim:

1. A stringed instrument comprising:

a) a body portion;

b) a fretted neck attached to said body portion at one end and having distal end opposite from said body portion;

c) a rigid frame portion attached to and extending from said body portion comprising a top extension, a bottom extension and a joining region wherein said top extension and said bottom extension are spaced from and run generally parallel for the length of said neck and are generally coplanar with said neck, wherein said joining region connects said top extension to said bottom extension beyond the distal end of said neck without contacting said neck; and d) a plurality of strings attached to said body portion extending lengthwise of said neck to said joining region.

2. The stringed instrument of claim 1 comprising a plurality of tuning machines mounted to said frame portion to which said strings are affixed.

3. The stringed instrument of claim 2 wherein said tuning machines are disposed in an extended headstock section of said joining portion.

4. The stringed instrument of claim 3 wherein strings extending from a bridge on said body portion to the tuning machines are at an angle to said extended headstock section.

5. The stringed instrument of claim 4 wherein said neck comprises a nut disposed at said distal end and where said angle is sufficient to allow the strings to form a straight line from said bridge across said neck over said nut to said tuning machines on said extended headstock portion.

6. The stringed instrument of claim 5 wherein said angle is 163°.

7. The stringed instrument of claim 1 wherein a plurality of string tie-downs are affixed to said joining region wherein said strings are held in place by said tie-downs.

8. The stringed instrument of claim 7 wherein said string tie-downs are spaced an equal distance from each tuning machine for each string.

9. The stringed instrument of claim 2 wherein said neck is slightly elevated from said joining portion such that a string extending lengthwise from said body portion over a nut disposed on said distal end of said neck produces a downward angle from the nut to tuning machines mounted to said frame portion.

10. The stringed instrument of claim 2 wherein tuning machines are positioned on an extended headstock portion such that said strings extend in a straight line from said body portion over to and in contact with a nut disposed on said distal end of the neck to said tuning machines mounted to said frame portion.

11. The stringed instrument of claim 1 wherein at least one pick-up is affixed to said body portion in a manner where said pick-up can receive vibrational tones from said strings.

12. A stringed instrument comprising:

a) a body portion;

b) a fretted neck attached to said body portion at one end and having a nut disposed thereon at a distal end from said body portion, c) a rigid frame portion attached to and extending from said body portion comprising a top extension, a bottom extension and a joining region wherein said top extension and said bottom extension are spaced from and running generally parallel and coplanar to the length of said neck, said joining region connecting said top extension to said bottom extension beyond the distal end of said neck without contacting said neck;

d) a plurality of tuning machines attached to an extended headstock portion of said joining region wherein-said strings are attached to said tuning machines to allow for adjusting the string tension for tuning purposes, said section being positioned in such a manner so that each string extending from said body portion, across said neck and over said nut to said tuning machines forms a straight line;

e) a plurality of strings attached to said body portion extending lengthwise of said neck across said nut to said tuning machines, said neck being elevated above the frame portion such that a string extending lengthwise from said body portion passing over said nut produces a downward angle from the nut to a tuning machine; and, f) a plurality of string tie-downs are affixed to said joining portion wherein said strings are held in place by said tie-downs wherein said tie-downs is spaced an equal distance from each said tuning machines.

13. The stringed instrument of claim 7 wherein at least one pick-up is affixed to said body portion in a manner where said pick-up can receive vibrational tones from said strings.

14. A stringed instrument comprising:

a) a body portion;

b) a fretted neck attached to said body portion at one end and having a nut disposed thereon at a distal end from said body portion, c) a rigid frame portion attached to and extending from said body portion comprising a top extension, a bottom extension and a joining region wherein said top extension and said bottom extension are spaced from and run generally parallel for the length of said neck and are generally coplanar with said neck, wherein said joining region connects said top extension to said bottom extension beyond the distal end of said neck without contacting said neck;

d) a plurality of tuning machines attached to an extended headstock portion of said joining region wherein said strings are attached to said tuning machines to allow for adjusting the string tension for tuning purposes, said section being positioned in such a manner so that each string extending from said body portion, across said neck and over said nut to said tuning machines forms a straight line;

e) a plurality of strings attached to said body portion extending lengthwise of said neck across said nut to said tuning machines, said neck being elevated above the frame portion such that a string extending lengthwise from said body portion passing over said nut produces a downward angle from the nut to a tuning machine; and, f) a plurality of string tie-downs are affixed to said joining portion wherein said strings are held in place by said tie-downs wherein said tie-downs is spaced an equal distance from each said tuning machines.

15. The stringed instrument of claim 1 wherein said neck comprises a nut disposed on the distal end.

* * * * *